United States Patent [19]

Hay

[11] 4,021,039

[45] May 3, 1977

[54] MINIATURE SIMULATED TENNIS GAME

[76] Inventor: Eric Ivan Hay, Teatergatan 6, 1/2 tr, Stockholm, Sweden, 111 48

[22] Filed: Apr. 9, 1975

[21] Appl. No.: 566,563

[30] Foreign Application Priority Data

Apr. 19, 1974 Sweden ..... 7405263

[52] U.S. Cl. ..... 273/85 B; 273/95 A; 273/DIG. 26

[51] Int. Cl.[2] ..... A63F 7/06

[58] Field of Search ..... 273/95 A, 58 C, 85 AU, 273/30, 29 R, 88, 26 E, 200 B

[56] References Cited

UNITED STATES PATENTS

| | | | |
|---|---|---|---|
| 1,682,329 | 8/1928 | Glavin | 273/85 B |
| 2,633,320 | 3/1953 | Salmi | 273/26 E |
| 3,477,717 | 11/1969 | Clark | 273/30 |
| 3,856,303 | 12/1974 | Payne | 273/85 B |
| 3,904,203 | 9/1975 | Matsumoto | 124/4 |

FOREIGN PATENTS OR APPLICATIONS

| | | | |
|---|---|---|---|
| 957,117 | 2/1950 | France | 273/85 R |
| 591,721 | 1/1934 | Germany | 273/85 R |
| 1,107,449 | 3/1968 | United Kingdom | 273/85 C |

OTHER PUBLICATIONS

Tomy Corp., Catalogue p. 6, 3/28/75.

*Primary Examiner*—Richard C. Pinkham
*Assistant Examiner*—Harry G. Strappello
*Attorney, Agent, or Firm*—Behr & Woodbridge

[57] ABSTRACT

A miniature tennis game apparatus includes a small simulated tennis court, a tennis ball suspended by a wire from an overhead mast and at least one hand manipulatable figure on each side of the simulated tennis court. The tennis ball is situated at one end of a pivotal lever arm the other end of which is counterbalanced by an adjustable counterweight. By adjusting the counterweight and the arm coupling, it is possible to change the speed and trajectory of the ball. The ball may be hit from one side of the court to the other through the use of the tennis figures which are manipulated by a rotatable push rod.

15 Claims, 6 Drawing Figures

MINIATURE SIMULATED TENNIS GAME

BACKGROUND OF THE INVENTION

1. Field of the Invention.

This invention relates to a miniature racket game, in particular, a miniature apparatus for simulating the play of the game tennis.

2. Description of the Prior Art.

There are several different types of miniature tennis games that are known to those of ordinary skill in the art. In one type, a tennis ball may be directed against the opponent's side of a simulated tennis court with the help of a leaf-like device. The leaf is hinged to the court and may be maneuvered by hand with the aid of a crossbar or with the help of a builtin spring under the leaf. Another variation of miniature tennis games is described in the patent to Ries, et al U.S. Pat. No. 1,102,954. According to that version, the play of the game is apparently dictated by the spin of an indicating needle, rather than by the agility of the tennis players. A tennis game requiring the skill and athletic agility of the opponents is disclosed in Italian Pat. No. 508,532. According to that disclosure, two tennis players who are rotatably mounted in a fixed position may be manipulated so as to drive a small ball back and forth over a sloping tennis court. While such a game does require a certain amount of athletic prowess, it does have certain major disadvantages. In particular, the players are immobily fixed on a rotatable spindle. Therefore, that player can only cover that portion of the court which comes within the length of his paddle arm. The game also has the disadvantage that the ball is generally confined to the plane of the table and cannot rise above the surface. In other words, the game is restricted to two-dimensional tennis and is not playable in three dimensions. The foregoing apparatus is typical of prior art tennis games and because such games give an unsatisfactory illusion of the game of tennis, they are frequently monotonous and lacking in excitement.

The use of tethered balls and the like is known in the context of other miniature court games. For instance, O'Carrol, U.S. Pat. No. 483,788 and Shatzer, U.S. Pat. No. 2,851,272 disclose the use of tethered or captive balls in the context of player paddle games. What is lacking in many of these games is either a sufficiently mobile ball and/or a sufficiently mobile player figure.

One relatively exciting player game is described in U.S. Pat. No. 3,105,687 and issued to D. H. Munro, et al. A similar technique is also discussed in Canadian Pat. No. 680,723 issued to Stein. In both cases, a hockey game playing mechanism is disclosed in which the hockey playing figures are both rotatably and horizontally manipulatable. The rotation of the hockey player figure is accomplished by turning a rod. The lateral movement of the figure is accomplished by pushing the same rod in and out. The pushing of the rod causes the figure to travel forward or backward in a slotted guide groove. While such a mechanism is known to those of ordinary skill in the art, it is believed that such games also can be monotonous and unchallanging because they are restricted to the two dimensional surface of the playing court.

SUMMARY OF THE INVENTION

The game disclosed herein is one in which the player figures may be manipulated both laterally and rotatably and in which the object ball is relatively free to move in the three dimensions. Because there are fewer constraints on the players and on the ball, the present invention is believed to simulate a real tennis game better than those previously known in the prior art.

Briefly described, the invention comprises a miniature tennis game court, at least one player figure located on each side of the tennis court and a tethered ball means which may be driven back and forth across the surface of the tennis court by the tennis figures. The tennis figures travel back and forth in a slot in the game court. The lateral movement of the player is controlled by pushing a control rod back and forth and the rotation of the player is controlled by turning the control rod about its axis. The ball is attached to a mast by a counterbalanced rod. The mast rises above the surface of the court and the rod is free to pivot around the top of the mast. The speed and trajecto ry of the ball can be adjusted by changing the position of the counterbalance weight relative to the fulcrum of the pivot point of the rod. The speed and trajectory can also be modified by adjustments on the fulcrum coupling means. A miniature simulated tennis net may be hung across the net line boundry in order to better suggest a real tennis court. Additionally, a plurality of beads or the like may be used to keep score in a manner similar to that of billiards.

Other advantages of the present invention will be more fully appreciated in view of the drawings.

DESCRIPTION OF THE INVENTION

Figure 1:
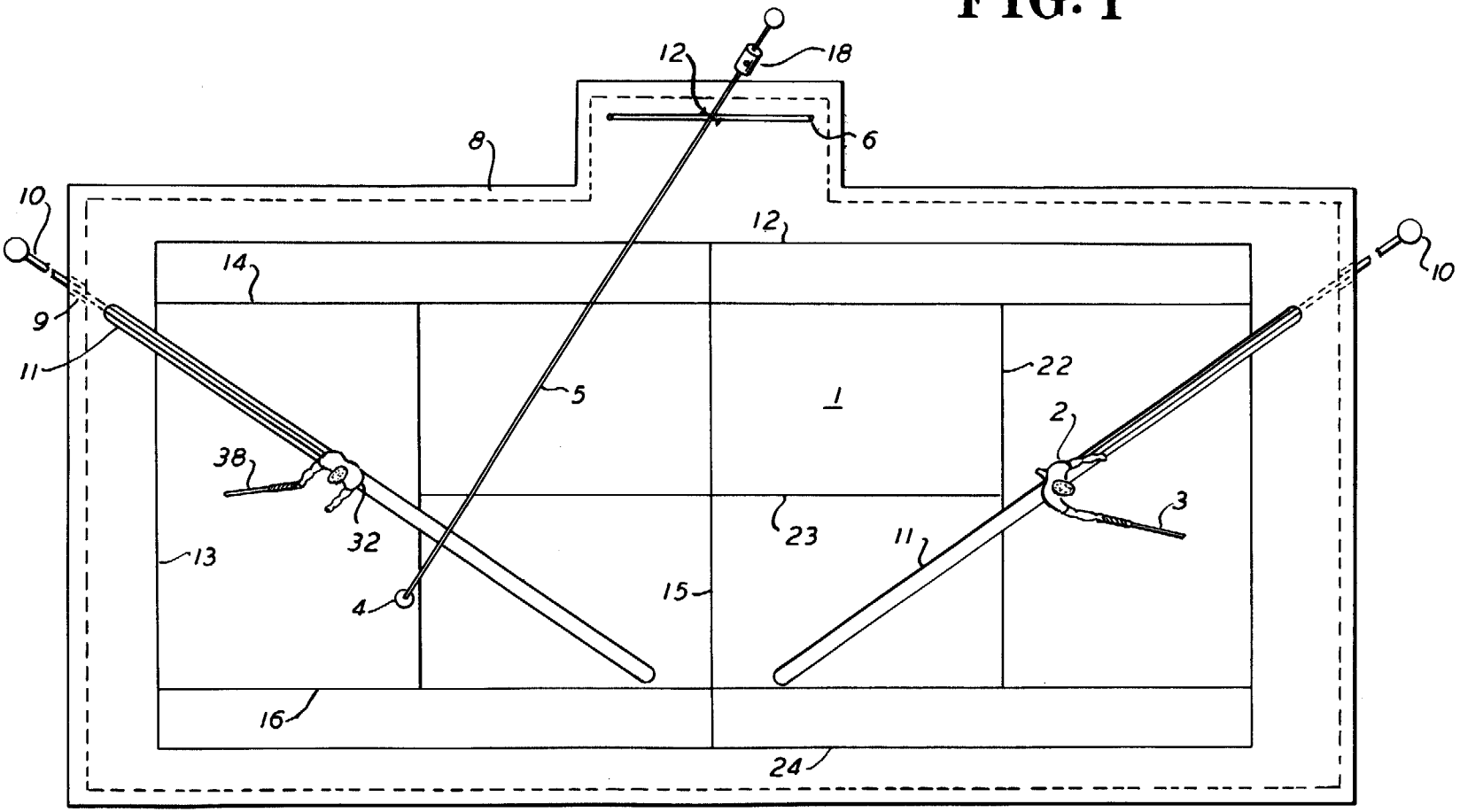
FIG. 1 is a top plan view of the present invention illustrating the general layout of the simulated tennis court; and, FIG. 2 is a side elevation of the invention illustrated in FIG. 1.

During the course of this description it will be apreciated that like numerals will be used to refer to like elements in FIGS. 1 through 6.

The tennis court 1 according to the present invention is laid out upon a board 7 which is built into a frame 8. The board 7 is preferably elevated a few inches above the surface upon which frame 8 rests. Frame 8 not only supports the board 7 but also supports rods 10 which pass through holes 9 in the short side of the frame.

The tennis court 1 is drawn accurately to reproduce in a smaller scale the characteristic lines of a standard size tennis court. The scaled down tennis court 1 of the present invention includes a pair of base lines 13, side lines for singles 14, 16; a transverse middle line 15; sevice lines 22 and a lengthwise center line 23. Sidelines 21 and 24 for the game of doubles are also marked out. Directly above the transverse middle line 15 is a miniature net 20. Net 20 may be reduced to the same scale as the reduction in size of the tennis court as a whole. A set of bead like scoring means 19 are located on one side of the court. The beads 19 serve as a counter and are used in a manner similar to keeping track of the score in a game of billiards. According to the preferred embodiment, the counter beads 19 are carried by mast 6.

Figure 2:
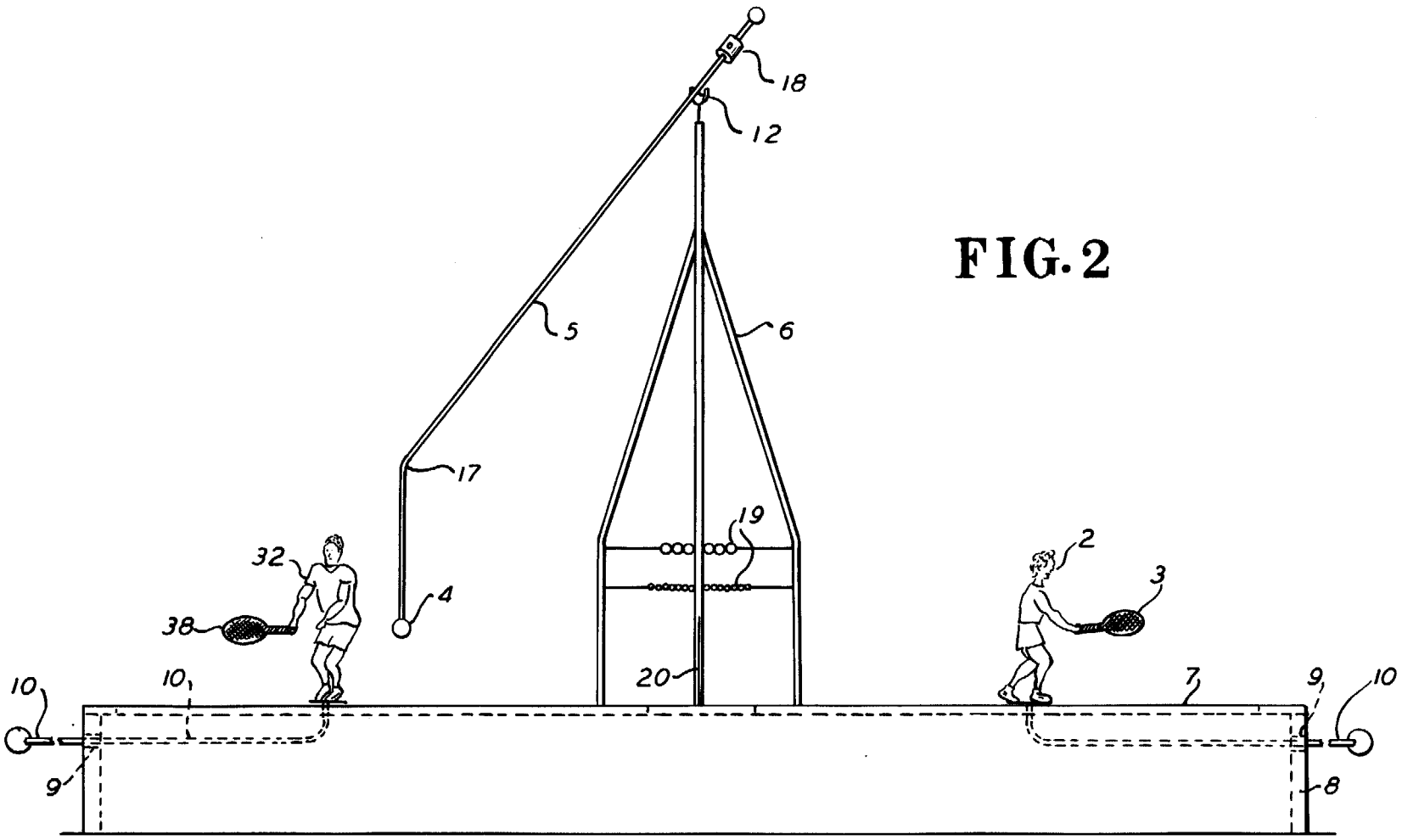

Movably mounted above the surface of tennis court 1 are a pair of movable tennis FIGS. 2 and 32. Each of the tennis FIGS. 2 and 32 are equipped with a simulated tennis racket 3 and 38. The playes 2 and 32 may be displaced anywhere along the length of slots 11. Slots 11 extend completely through the surface of tennis court 1. According to the preferred embodiment, the slots 11 run from a point a short distance outside of the court base line 13 and approximately in line with the sideline 14 to a short distance from the transverse middle line 15 to the other sideline 16. In other words, the slots extend very roughly diagonally from the corner of middle line 15 and transverse line 15 to the corner of base line 13 and side line 14. While the path shown for slot 11 is approximately diagonal, it will be appreciated that this does not necessarily have to be the exact position of the slot for effective play to take place.

The movement of the tennis FIGS. 2 and 32 along the slot 11 is accomplished by the manipulation of rods 10. The tennis FIGS. 2 and 32 serve as a hitting means which ride upon a mechanism carried by rods 10. Rods 10 serve as a manipulating means. Prior art devices are known which will allow for the manipulation of a playing figure by a rod and slot mechanism. An example of such a mechanism is disclosed in the patent to Munroe, et al U.S. Pat. No. 3,105,687. Another such mechanism is disclosed in Canadian Pat. No. 680,723 issued to Stein. The rods 10 extend through holes 9 in the short side of frame 8 in a manner that was previously described. The rods 10 are movable forwardly and backwardly under slots 11.

An angle coupling is used to transfer rotation of the rod to the tennis figure. Additionally, the rods 10 may be used to position the figure anywhere along the path of the slot. Therefore, by rotating the rod and moving it in and out of hole 9, the player is able to directly control the rotation and position of player FIGS. 2 and 32.

Mast 6 is firmly attached to either the board 7 or frame 8 and is offset a few inches therefrom. The mast rises vertically from the surface of the board 7 above the heads of the tennis player FIGS. 2 and 32. At the end of mast 6 is located a coupling or pivot means 12. Rotatably attached to coupling 12 is the rigid steel wire 5. A simulated tennis ball 4 is located at one end of the steel wire and a counterweight 18 is located at the other. Counterweight 18 is slideable along the length of the wire and may be adjusted so as to control the steady state position of ball 4 relative to the tennis playing FIGS. 2 and 32. Preferably, counterweight 18 is adjusted so that ball 4 will rest a fixed distance above the surface of the tennis court 1. That fixed distance also corresponds to the height of the simulated playing racket 3 above the surface of tennis court 1. In other words, tennis ball 4 lies roughly in the same plane as simulated tennis rackets 3 and 38.

Mast 6 is positioned in such a fashion that coupling 12 falls in line with an extension of middle line 15 when the miniature tennis game is viewed from above as seen in FIG. 1. This positioning guarantees that the tennis ball 4 will evenly sweep the area on both sides of the court. The coupling 12 cooperates with the rod 5 and mast 6 so as to allow the wire to swing easily in the vertical and the horizontal direction limited only by the reach of the wire 5 itself. The length of wire 5 and the height of the coupling 12 over the court are arranged so that when ball 4 is hit it will fall within the "reach" of one of the player FIGS. 2 or 32. In order to reduce the risk that the wire 5 will hit a player FIG. 2 or 32, the wire is constructed with a bend 17 so that that part of the wire 5 between bend 17 and ball 4 has an angle such that when ball 4 comes into striking contact with respect to court 1 the wire 5 will be at approximately 90° wth respect to the horizontal plane of court 1. Therefore bend 17 ensures that ball 4 will strike court 1 at a right angle during the travel of ball 4. The speed and position of ball 4 may be adjusted by changing the position of sliding counterweight 18. Counterweight 18 may be locked in any desirable position along the length of wire 5 by adjusting a small set screw therein.

In operation, the singles game is played according to rules similar to that of a professional game of tennis. For example, one player will serve and the other player will return the ball if he can. If a volley is established, then play continues until one of the players hits the ball out of the court. Obviously, it takes a lot of ability to manipulate player FIGS. 2 and 32 so that they are in position to effectively strike ball 4 with racket 3. The positioning of the FIGS.. 2 and 32 along the length of slots 11 is controlled by pushing rod 10 in and out of hole 9. Once the player 2 is in position, then rod 10 must be rotated so as to cause the FIG. 2 to rotate. Rotation of FIGS. 2 causes the racket 3 to strike ball 4, if ball 4 is in the correct position relative to racket 3. Therefore, the players must master the skill of position and timing in order to play a effective game.

Figure 3:
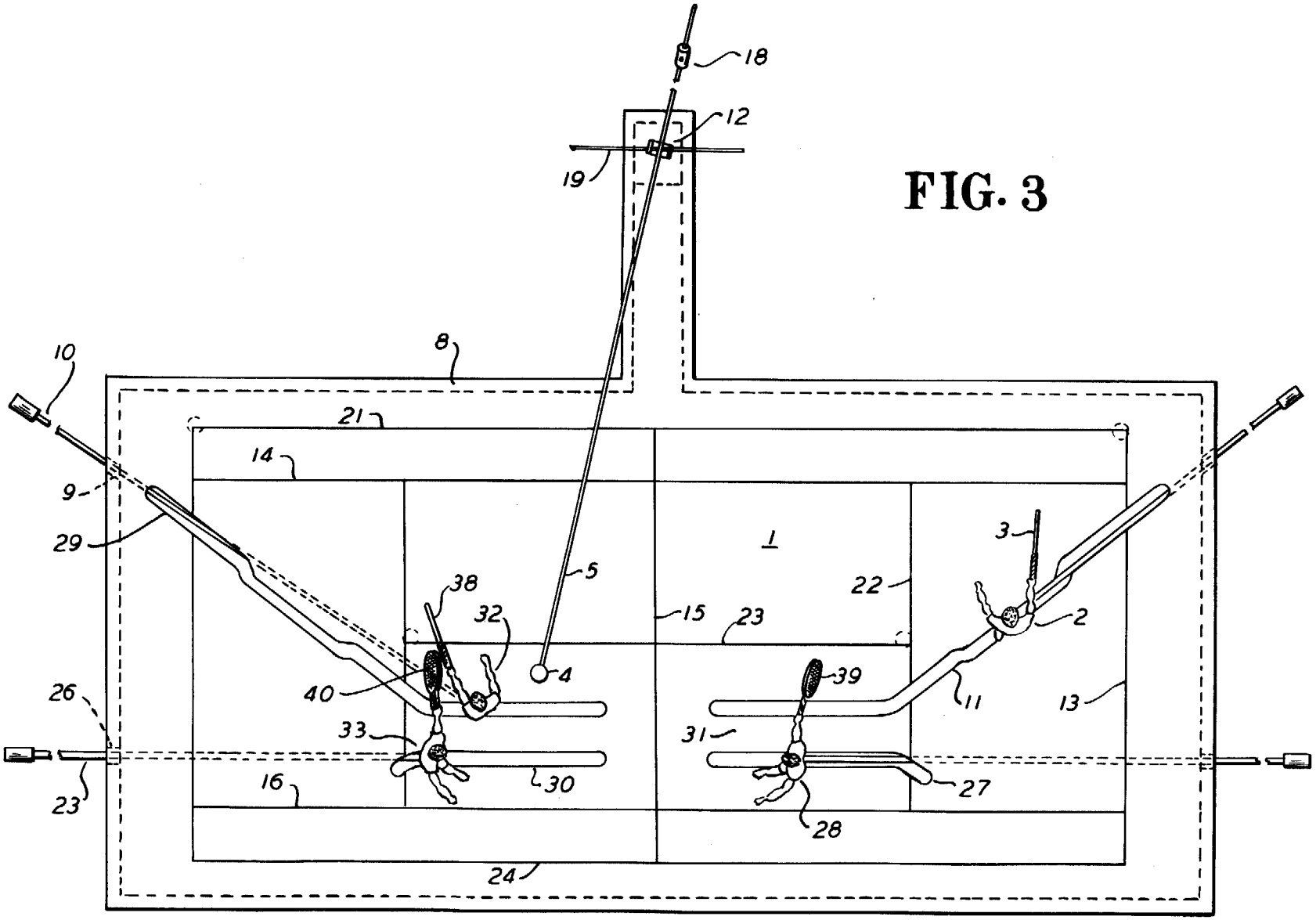
FIG. 3 is a top plan view of another embodiment of the present invention adapted for the game of tennis doubles.
Figure 4:
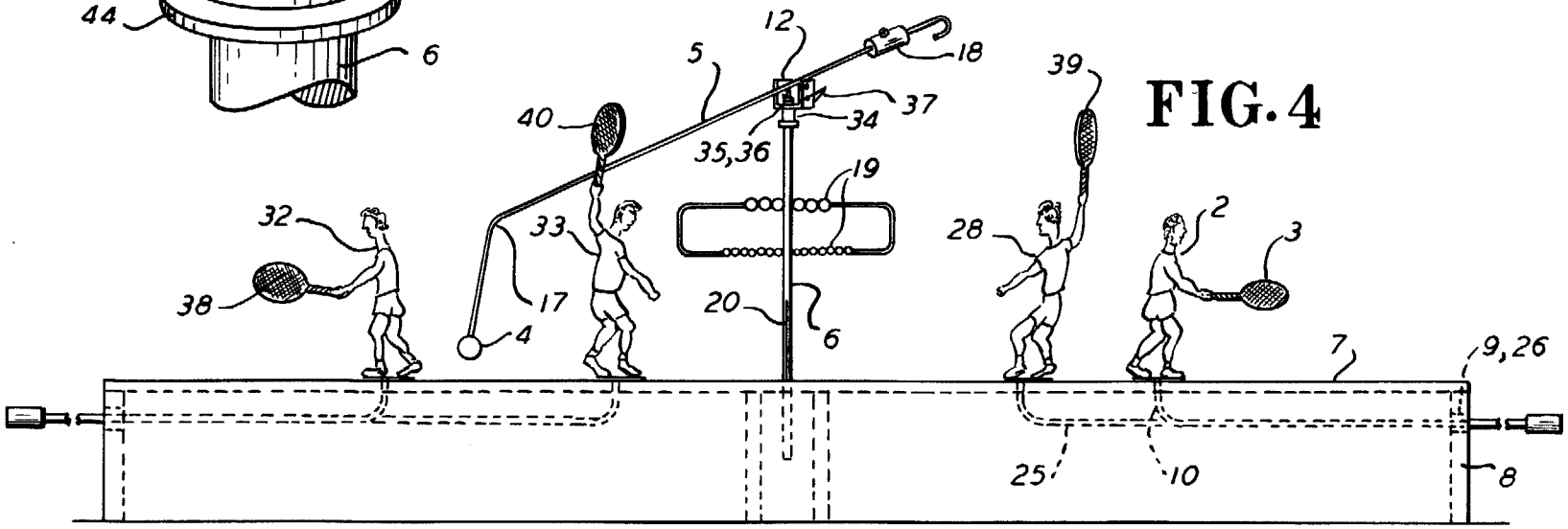
FIG. 4 is a side elevation view of the embodiment of FIG. 3.

Another embodiment of the present invention especially adapted for the game of doubles is illustrated in FIGS. 3 and 4. The game of doubles is played with player FIGS. 2, 28, 32 and 33. The two players 28 and 33 can be displaced over the surface of the court as limited by open slots 27 and 30. Slots 27 and 30 run in a specific pattern that allow the rackets 39 and 40 of players 28 and 33 respectively to hit ball 4. The displacement of player FIGS. 2, 28, 32 and 33 along slots 11, 27, 29 and 30 is accomplished through the use of rods 10 and 25 which run through holes 9 and 26 in the short sides of frame 8 and are movable backwards and forwards under slots 11, 27, 29 and 30. As in the embodiment of FIGS. 1 and 2, the rods 10 and 25 are rotatable about their longitudinal axis and player FIGS. 2, 28, 32 and 33 are attached thereto by a slip on connection of the type known to those of ordinary skill in the art. Likewise, in a manner previously described, the rods 10 and 25 rotate the player figures through an angle coupling of the type known to those of ordinary skill in the art. By quickly rotating one of the rods 10 or 25, it is possible for a player FIG. 2, 28, 32 or 33 to direct a blow from racket 3, 38, 39 or 40 to the ball 4 which is affixed to one end of steel wire 5. Also, in a manner previously described with reference to FIGS. 1 and 2, the other end of steel wire 5 is suspended by a coupling 12 which is connected to a mast 6. Mast 6 is firmly attached at one side of the game's court with its vertical center line aligned with imaginary extension of transverse middle line 15. The coupling 12 of this embodiment is constructed so that wire 5 is allowed to swing at adjustable speeds and trajectory in the vertical as well as the horizontal direction. The length of the wire 5 and the height of the coupling 12 over the surface of the court 1 is arranged so that ball 4, when hit against the court, comes within the reach of player FIG.

2, 28, 32 and 33. In order to reduce the risk that racket 3 will hit the wire 5, the wire 5 is designed with a bend 17 so that that part of the wire 5 between bend 17 and ball 4 is situated at an angle of approximately 75° with respect to court 1 whenever the ball 4 makes contact therewith.

While the embodiment of FIGS. 3 through 4 is especially adapted for the game of doubles, it can also be used for the game of singles. In order to play the game of singles with the embodiment of FIGS. 3 through 4, one merely removes two of the four player figures, for example, FIGS. 28 and 33, and plays with the remaining two player FIGS. 2 and 32.

Figure 5:
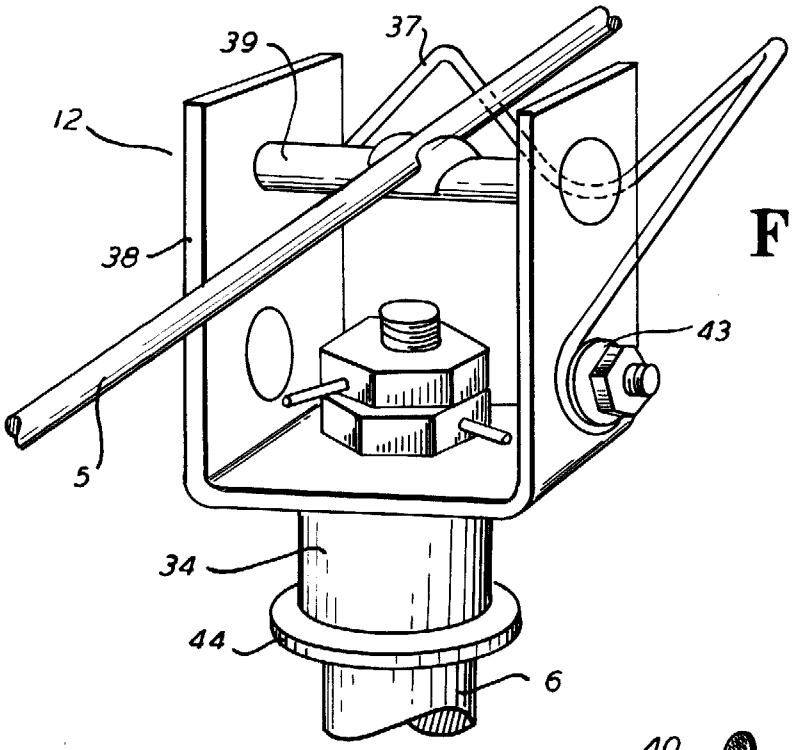
FIG. 5 is a prespective view of the coupling 12 used in the embodiments of FIGS. 3 and 4.

A preferred coupling 12 of the sort employed in the doubles embodiment of FIGS. 3 and 4 is shown in detail in FIG. 5. The coupling 12 rides on top of rubber collar 34 which is situated on top of metal mast 6. The U-shaped bracket support 38 is attached to the mast and rubber collar by adjustable lock nuts 35 and 36. A rotatable axle 39 passes through the upright portions of bifurcated bracket 38 and supports in the middle thereof the stiff wire 5 which is welded thereto. A spring stop wire 37 straddles the upright portions of the bracket 38 and serves to limit the vertical up and down movement of the wire 5.

The speed and trajectory of the ball 4 as it is played over court 1 can be varied by adjusting the elements associated with coupling 12. In particular, the speed and trajectory of ball 4 can be altered by moving the position of sliding weight 18; or by adjusting the degree of pressure placed upon rubber collar 4 by the position of lock nuts 35 and 36 or by manipulating the angle of elevation or the degree of springyness of wire spring stop 37. The purpose of rubber collar 34 is to serve as a frictional or damping element to manipulate the horizontal movement of the ball 4. While several different couplings 12 have been described, the embodiment shown in FIG. 5 has been found to be the most suitable because it allows the game players to adjust the speed of the game to their own particular athletic abilities.

Figure 6:
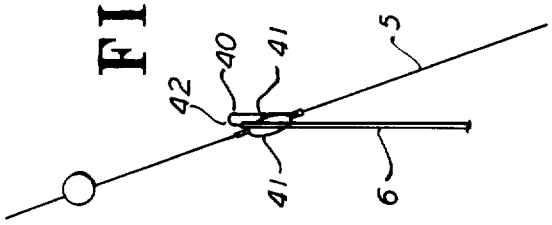
FIG. 6 is a detailed perspective view of another coupling embodiment suitable for use with the present invention.

Another type of usable coupling is illustrated in FIG. 6. This coupling 40 includes a pin means 41 and a pair of limit means 42. The pin means 41 is rigidly connected to wire arm 5 and engages a detent in the top of mast 6. The pin and detent arrangement allows the ball 4 to move virtually unrestricted in any direction limited only by the wire limit means 41.

The rubber collar 34 is separated from mast 6 by a metal washer 44. By screwing lock nuts 35 and 36 down on their threaded stud it is possible to increase the damping friction by putting collar 34 under increased compression between bracket 38 and washer 44. The location of spring stop wire 34 can be adjusted by means of lock nuts 43 which are attached to a counter sunk screw. This adjustment in turn controls the vertical rebound of the mast 5 and hence the height of travel of ball 4.

While the invention has been particularly shown and described with reference to the preferrd embodiment thereof, it will be understood by those skilled in the art that various changes in form and detail may be made therein without departing from the spirit and scope of the invention.

I claim:

1. A miniature simulated tennis game comprising:

a tennis game court surface divided into at least two sides by boundaries including at least a base line, a service line, a side line and a net means, said net means serving as a boundary for dividing said court into said two sides, said two sides being of approximately equal area;

a hitting means comprising at least one simulated tennis player figure located on each side of said court, each tennis player figure being equipped with a simulated tennis racket;

a manipulating means for manipulating said simulated tennis player figures by hand; and, a ball means attached to a rigid arm means, said arm means being attached to a mast which rises above the surface of said court by a coupling means including a bracket rotatably attached to said mast and an axle pivotally connected to said bracket, said arm means being substantially rigidly connected to said axle;

wherein the ball means is adapted to be struck by said hitting means and thereby volleyed between the two sides of said court.

2. The game of claim 1 wherein said coupling means includes a stop means for limiting the vertical movement of said arm means.

3. The game of claim 2 wherein said coupling includes a friction means for damping the balls' movement in the horizontal plane.

4. The game of claim 3 wherein said stop means comprises a springy wire; and, said friction means comprises a rubber collar disposed between said bracket and said mast.

5. A miniature simulated tennis game comprising;

a miniature tennis court surface divided into at least two sides by boundaries, each side of said tennis court including at least one slot therethrough, said slot extending approximately diagonally across each of said sides of said court, said boundaries of said miniature tennis court including at least a base line, a service line, a side line and a net means, said net means serving as a boundary for dividing said court into said two sides, said two sides being of approximately equal area;

at least one simulated tennis player figure equipped with a simulated tennis racket located on each side of said court;

a manipulating means for manipulating each simulated tennis player figure by hand, said manipulating means including a rotatable rod and a swivelling means located under said court surface, said rod having the first end thereof adapted to extend beyond the base line of said court and a second end connected to said swivelling means, said swivelling means being adapted to support and rotate said tennis figure in response to the manipulation of the first end of said rotatable rod; and, a ball means attached to a rigid arm means, said arm means being pivotally attached to a mast which rises above the surface of said court, said arm means comprising a rigid wire including a simulated tennis ball at a first end thereof, a pivotal section and a counterweight at a second end thereof, said rigid wire including a bend therein between said first end and said pivotal section, said bend in said wire being such that the tennis ball strikes the game court at approximately right angles during the course of the game play, wherein the ball means is adapted to be struck by the simulated tennis player figures and thereby volleyed between the two sides of said court.

6. The game of claim 5 wherein said counterweight is movable along said rod so that the speed of the tennis ball may be regulated.

7. The game of claim 6 wherein said mast includes a plurality of bead-like means for keeping score therewith.

8. The game of claim 5 wherein said game includes at least two of said simulated tennis playing figures.

9. The game of claim 5 wherein said game includes four of said simulated tennis player figures.

10. The game of claim 5 wherein said arm means is rotatably attached to said mast by a coupling means.

11. The game of claim 10 wherein said coupling means includes a U-shaped bracket rotatably attached to said mast and an axle pivotally connected to said bracket, said arm means being rigidly connected to said axle.

12. The game of claim 11 wherein said coupling means includes a stop means for limiting the vertical movement of said arm means.

13. The game of claim 12 wherein said coupling includes a friction means for damping the ball's movement in the horizontal plane.

14. The game of claim 13 wherein said stop means comprises a springy wire; and, said friction means comprises a rubber collar disposed between said bracket and said mast.

15. The game of claim 10 wherein said mast includes a detent in the top thereof; and, said coupling means comprises a pin means associated with said arm means and which is engagable in said detent, said pin means being surrounded by a pair of limit means to limit the movement of said arm.

* * * * *